United States Patent [19]

Bouvier

[11] 4,136,866

[45] Jan. 30, 1979

[54] SKIP ROPE

[76] Inventor: Ronald O. Bouvier, 91 Woodland Rd., Holden, Mass. 01520

[21] Appl. No.: 837,926

[22] Filed: Sep. 29, 1977

[51] Int. Cl.[2] ..... A63B 5/20

[52] U.S. Cl. ..... 272/75; 16/110 R

[58] Field of Search ..... 272/75, 74, 68, 122, 272/124; 273/67 R, 67 DA, 67 DB, 67 DC, 75, 81 B, 81 R, 76; 16/110 R, 110 A, 110.5; 46/1 G

[56] References Cited

U.S. PATENT DOCUMENTS

| | | | |
|---|---|---|---|
| 1,629,209 | 5/1927 | Fairbanks | 272/75 |
| 1,651,057 | 11/1927 | Goldstein | 272/75 |
| 1,666,201 | 4/1928 | Goldstein | 272/75 |
| 2,012,637 | 8/1935 | Ribley | 16/110 R X |
| 3,269,399 | 8/1966 | Smith | 272/81 R X |
| 3,363,898 | 1/1968 | Crovello | 272/75 |
| 3,770,033 | 11/1973 | Gavillet et al. | 273/81 R X |

FOREIGN PATENT DOCUMENTS

| | | | |
|---|---|---|---|
| 542465 | 5/1922 | France | 272/75 |
| 6467 of | 1909 | United Kingdom | 272/75 |
| 382807 | 11/1932 | United Kingdom | 272/75 |
| 775736 | 8/1956 | United Kingdom | 272/75 |
| 1217867 | 12/1970 | United Kingdom | 272/75 |

*Primary Examiner*—Richard C. Pinkham
*Assistant Examiner*—Arnold W. Kramer
*Attorney, Agent, or Firm*—Norman S. Blodgett; Gerry A. Blodgett

[57] ABSTRACT

A skip rope has handles each having a bore at one end in which is inserted a tubular housing having top and bottom inwardly-extending flanges and a top outwardly-extending flange located in the same plane as the top inwardly-extending flange which forms a stop when the housing is inserted in the handle. A bearing locked within the top and bottom inwardly-extending flanges has an outer race locked against rotation and an inner race separated from the outer race by anti-friction elements. The inner race has a central bore and is elongated with respect to the outer race and protrudes externally of the housing and handle. Each end of the skip rope runs through the bore of the inner race of a handle and is held in place by an enlargement at its inner end.

4 Claims, 6 Drawing Figures

FIG. 1
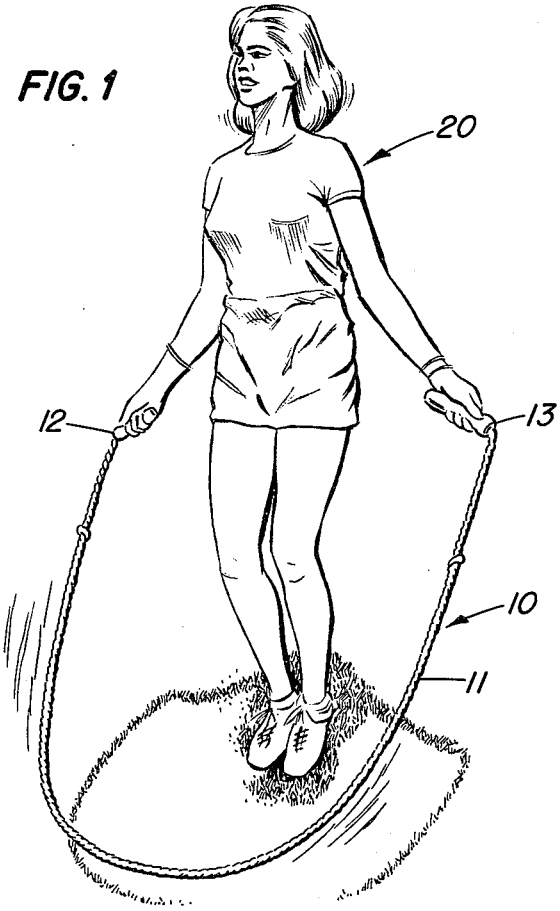
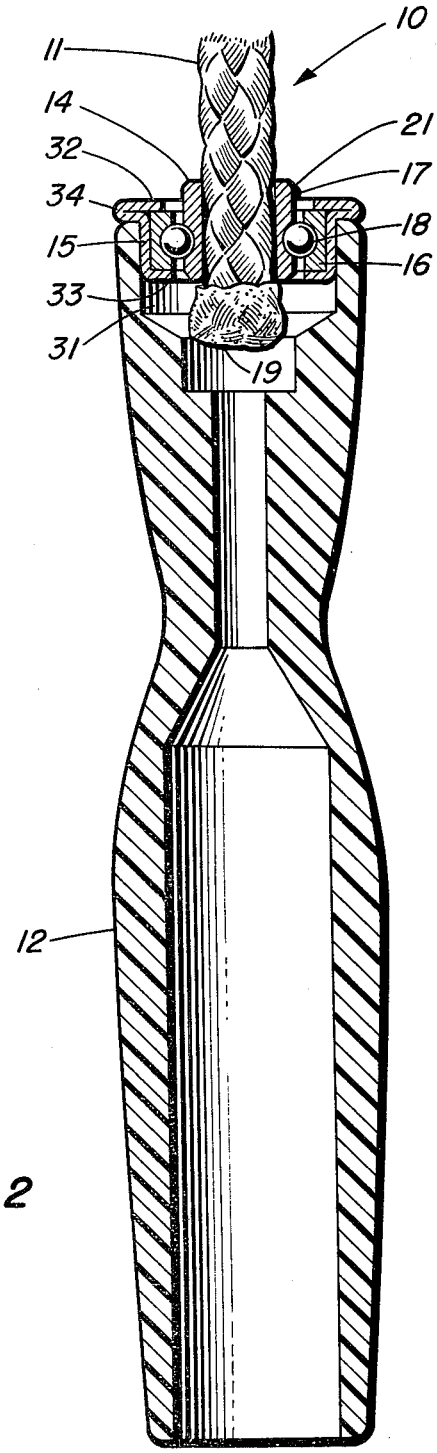
FIG. 2

FIG. 3
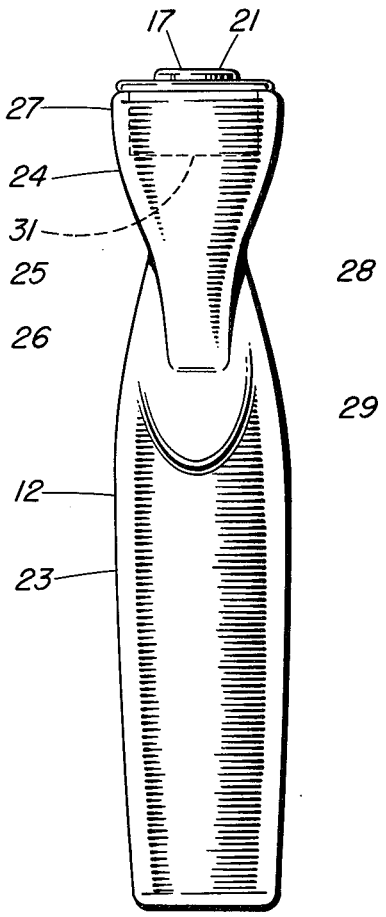
FIG. 4
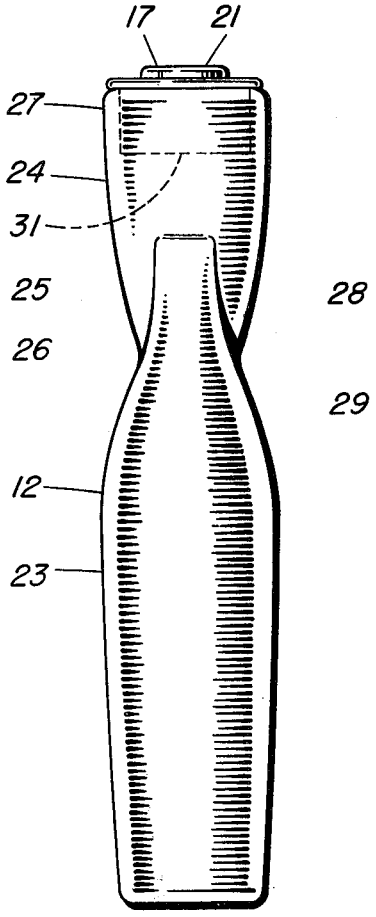
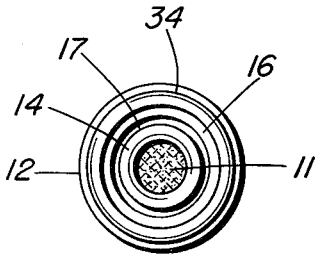
FIG. 5
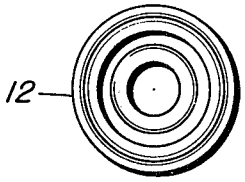
FIG. 6

SKIP ROPE

BACKGROUND OF THE INVENTION

Skip ropes are usually made with a length of rope having handles at each end. Previously, in many cases these have been provided with ball bearings. However, a considerable problem has been presented by the fact that the ferrule which holds the bearing on the end of the handle is engaged by the rope and this not only presents friction against the rope, but also eventually causes the rope to deteriorate. Also, improperly designed handles can be very uncomfortable for the user. If poorly designed, they may cause something as serious as blisters on the users palms, or it could constitute one excuse for the user not doing his skip rope excercises. These and other difficulties experienced with the prior art devices have been obviated in a novel manner by the present invention.

It is, therefore, an outstanding object of the invention to provide a skip rope that does not kink or fray.

Another object of this invention is the provision of a skip rope which is easy to swing, thereby making a longer exercise period possible.

A further object of the instant invention is the provision of a hand-conforming handle which is both comfortable and which does not cause painful chafing during use.

It is another object of the instant invention to provide a inexpensive exercise apparatus which permits good exercise and yet is convenient and easy to use.

With these and other objects in view, as will be apparent to those skilled in the art, the invention resides in the combination of parts set forth in the specification and covered by the claims appended hereto.

SUMMARY OF THE INVENTION

In general, the present invention consists of a skip rope using a bearing locked in the end of the handle by the use of a housing. Locked in this housing is the outer race which is held against rotation. The inner race is separated from the outer race by anti-friction elements and is considerably more elongated in the axial direction than the outer race. The inner race protrudes from the face of the bearing to form a lip, the advantage being that the rope engages the inner race which is free to rotate with it and, thereby, has a minimum of rotational friction. The present invention also includes specially designed, hand-conforming handles.

BRIEF DESCRIPTION OF THE DRAWINGS

The character of the invention, however, may be best understood by reference to one of its structural forms, as illustrated by the accompanying drawings, in which:

FIG. 1 is a perspective view of the skip rope in use,

FIG. 2 is a cross-sectional view of a single handle with the rope attached,

FIG. 3 is a front view of the handle,

FIG. 4 is a side view of the handle,

FIG. 5 is a top view of the handle, and

FIG. 6 is a bottom view of the handle.

DESCRIPTION OF THE PREFERRED EMBODIMENT

Referring first to FIG. 1, wherein are best shown the general features of the invention, the skip rope, indicated generally by the reference numeral 10, consists of a rope 11 with handles 12 and 13 attached to its ends. The skip rope is shown with a user 20.

Referring next to FIG. 2, a cross-sectional view of the handle 12 is shown with the bearing 14 mounted in its end. It should be noted the the bearing housing 15 (in which the bearing 14 is locked) consists of a tube of sheet metal whose main body fits snugly into a cylindrical cavity 31. This housing has a top inner flange 32 and a bottom inner flange 33 which together lock the bearing outer race 16 firmly in place. The housing also is constructed with a top outer flange 34 located in the same plane as the top inner flange 32, thus forming a stop with the housing 15. The bearing 14, therefore, consists of an outer race 16 locked against rotation and an inner race 17 separated from the outer race by anti-friction element 18 and elongated with respect to the outer race. The rope 11 runs through the center of the inner race 17 and is held in place by an enlargement 19. The extra length of the inner bearing 17 over the outer bearing 16 causes a protrusion 21 from the face of the bearing.

In the preferred embodiment, the elongated rope 11 consists of woven nylon strands whose construction is commonly known. The enlargement 19 is then formed by heating the end of the rope 11 after it has been inserted in the bearing 14 and pressing it into an integral ball.

Referring now to FIG. 3, in the preferred embodiment the handle is formed of plastic and consists of a modified elongated cylinder having a main section 23 shaped with a slight taper which increases from one end for approximately two-thirds of the total length. Also, it has a remaining portion 24, the shape of which consists of two forms 25 and 26, each comprising a modified cylinder with opposite flattened and tapered sides and, perpendicular to these sides, oppositely rounded tapered sides. These forms are located such that the large diameter end 27 of the first form 25 provides an end of the handle 12 and their smaller ends engage such that their respective flat sides are perpendicular to each other. The perpendicular engagement 28 in FIGS. 3 and 4 should be noted. The large diameter end of the second form 26 acts as a transition portion 29 in a continuous manner with the large diameter end of the main section 23. Also, the cylindrical cavity 31 is located at the remaining portion end 27 of the handle 12 to accommodate the bearing housing 15.

The operation of the invention will now be readily understood in view of the above description. The user 20 grasps the handle 12 and 13 in her hands and by a circular motion with her arms and wrists, she swings the rope 11 around her.

The rotation of the rope 11 with respect to the handle 12 and 13 causes a similar rotation of the inner race protrusion 21. As can be seen in FIG. 1, the rope 11 assumes a nearly perpendicular relationship to the handle 12 and 13. Also, it can be seen that, since the rope 11 engages the inner race 17 and because that inner race 17 protrudes from the face of the bearing, the rope 11 will never engage a surface that is not free to rotate with it. In particular, if the ends of handles 12 and 13 were to engage the rope 11, the rope would be slower and would possibly deteriorate after prolonged use.

The peculiar shape of the handles 12 and 13 assist the user in controlling the swing pattern of the rope and is able to do so without chafing the hands of the user. The shape of the handles lends itself to fabrication from plastic by the injection molding process.

It is obvious that minor changes may be made in the form and construction of the invention without departing from the material spirit thereof. It is now, however, desired to confine the invention to the exact form herein shown and described, but it is desired to include all such as properly come within the scope claimed.

The invention having been thus described, what is claimed as new and desired to secure by Letters Patent is:

1. Skip rope, comprising:

(a) a pair of handles, each handle having a bore at one end, (b) a tubular housing for insertion in the bore of each handle in a snug fit, the housing having top and bottom inwardly-extending flanges, and a top outwardly extending flange located in the same plane as the top inwardly-extending flange, thus forming a stop when the housing is imbedded in the handle, (c) a bearing locked within the top and bottom inwardly-extending flanges of each housing, the bearing having an outer race locked against rotation and an inner race separated from the outer race by anti-friction elements and having a central bore, the inner race being elongated with respect to the outer race and protruding externally of the housing and handle, and (d) an elongated rope, each end of the rope running through the central bore of one of said inner races, the end of the rope being held in place by an enlargement at its end.

2. Skip rope dependent from claim 1, wherein the elongated rope is formed of nylon and the enlargement is formed by melting the rope end.

3. Skip rope as recited in claim 1, wherein each handle consists of a modified elongated cylinder having a main section shaped with a slight taper increasing from one end for approximately two-thirds of the total length, and a remaining portion, the shape of which consists of two forms each comprising a modified cylinder with opposite flattened and tapered sides and perpendicular to these sides opposite roundly tapered sides, these forms being located such that the large end of the first form comprises an end of the handle and their smaller ends are engaged, so that their respective flat sides are perpendicular to each other, and the large end of the second form joins the large end of the main section in a continuous manner, and a cylindrical cavity is provided at the remaining portion end of the handle to provide the bore to accommodate the bearing housing.

4. Skip rope as recited in claim 1, wherein each handle consists of a main cylindrical portion having one end flattened into a spade-like shape lying in a first general plane, the handle having a short portion which also is flattened into a spade-like shape lying in a general plane at a right angle to the said first plane, the spade-like shapes extending in opposite directions and being coextensive over a substantial portion of their lengths.

* * * * *